US009725292B2

(12) United States Patent
Friedlich

(10) Patent No.: US 9,725,292 B2
(45) Date of Patent: Aug. 8, 2017

(54) REFUELLING STAND

(71) Applicant: Martin Friedlich, Ottawa (CA)

(72) Inventor: Martin Friedlich, Ottawa (CA)

( * ) Notice: Subject to any disclaimer, the term of this patent is extended or adjusted under 35 U.S.C. 154(b) by 0 days.

(21) Appl. No.: 14/976,837

(22) Filed: Dec. 21, 2015

(65) Prior Publication Data

US 2016/0137475 A1 May 19, 2016

Related U.S. Application Data

(63) Continuation-in-part of application No. 14/288,735, filed on May 28, 2014, now Pat. No. 9,216,886.

(51) Int. Cl.

| | |
|---|---|
| ***B65B 39/00*** | (2006.01) |
| ***B67C 11/02*** | (2006.01) |
| ***B67D 7/04*** | (2010.01) |
| ***B67D 7/84*** | (2010.01) |
| ***B67C 11/00*** | (2006.01) |

(52) U.S. Cl.
CPC ..... *B67C 11/02* (2013.01); *B67C 11/00* (2013.01); *B67D 7/04* (2013.01); *B67D 7/845* (2013.01)

(58) Field of Classification Search
CPC ..... B67C 11/02; B67C 11/00
See application file for complete search history.

(56) References Cited

U.S. PATENT DOCUMENTS 1,018,228 A * 2/1912 Hubbart ..... B65B 67/12 141/314
1,408,865 A 3/1922 Cowell
1,831,832 A * 11/1931 Wise ..... H05B 3/00 141/364
2,189,967 A * 2/1940 Sprouse ..... B67C 11/02 141/334
2,777,293 A * 1/1957 Hawkins ..... B60T 17/222 141/334
4,245,666 A 1/1981 Norris
4,338,983 A * 7/1982 Hatcher ..... B67C 11/02 141/331
4,600,125 A * 7/1986 Maynard, Jr. ..... B67B 7/28 141/330
5,720,329 A 2/1998 Clarke, Jr.
5,878,799 A * 3/1999 Hannick ..... B64F 1/28 141/231
6,070,769 A 6/2000 Hornsby
6,109,313 A 8/2000 Phelps
6,273,155 B1 8/2001 Cacho
6,293,505 B1 9/2001 Fan
6,845,784 B2 1/2005 Pascznk
7,048,020 B2 5/2006 Durieux
7,464,735 B2 12/2008 Shultz
7,472,727 B1 * 1/2009 Sherrard ..... B65B 67/04 141/10

* cited by examiner

*Primary Examiner* — Jason Niesz

(57) ABSTRACT

A refuelling stand that is lightweight and easily portable which includes A refuelling stand for conveying fuel from a fuel source into a fuel receptacle comprising: a funnel which is optionally collapsible; a conduit having a first end for removable attachment to the funnel, and a second end for engagement with the fuel receptacle; and three or more support legs, wherein each of the support legs is independently movable from a first use mode to a second storage mode. The conduit can be made of flexible material which may be rolled up for storage alongside the support or may be formed of inflexible tubing. The refuelling stand may optionally include at least one stabilizing element.

18 Claims, 10 Drawing Sheets

REFUELLING STAND

REFERENCE TO RELATED APPLICATIONS

The present application is a Continuation-in-Part of U.S. application Ser. No. 14/288,735 filed May 28, 2014, which issued as U.S. Pat. No. 9,216,886 ON Dec. 22, 2015, which is a continuation of U.S. application Ser. No. 13/183,860 filed Jul. 15, 2011, now abandoned.

FIELD OF THE INVENTION

The present invention pertains to the field of fuelling systems and, more particularly, to a refuelling stand with a funnel, a funnel support and a conduit which is removably connected to the funnel. The funnel stand is particularly well suited for refuelling boats and other recreational crafts which are not easily refuelled at traditional gas pumps.

BACKGROUND

Filling up a fuel tank on a small boat, personal watercraft or other watercraft can be difficult, potentially dangerous in rough water, and often results in damaging fuel spills. This is because the watercraft is typically floating and rocking on the water and, for small vessels, the fuel tank opening is usually located at or below the level of the dock where the operator can safely walk and stand. This makes it inconvenient and often quite difficult and potentially dangerous to fill the tank while standing or kneeling on the dock, especially in rough water and high waves caused by boat wakes. When onboard the vessel or next to it on the dock, it is physically demanding on the arms and back to stand and hold a hand-held gas can and try to pour the fuel directly into the tank opening.

The difficulty with easy and quick refuelling of small vessels, such as personal watercraft and small motor boats, is particularly acute on lakes which have no marina to supply a ready source of fuel. Most small lakes scattered throughout North America, which allow motorized crafts, do not have marinas therefore there is no choice but to bring fuel from land based stations. On larger lakes with marinas, taking the watercraft to a marina for fuelling can be very time consuming and many marinas experience long lines during peak times, when the boat owners would much prefer to be out on the water rather than traveling to the marina and waiting to fill up the fuel tank. In addition, fuel at land based gas stations is typically less expensive than at marinas. These factors provide strong incentives for filling up the watercraft's fuel tank with gas purchased at a land-based station. Nevertheless, the difficulties experienced with fuelling the watercraft from a hand-held fuel can still inhibit many boaters from fuelling the watercraft in this manner. In fact, without some type of device to help deliver the fuel from a hand-held fuel can or other suitable container into the fuel tank on the watercraft in a clean and safe manner, many boaters elect to use the marina despite the associated drawbacks. And many small boat and personal watercraft owners who have tried to fill their watercraft with a hand-held fuel can have stories of being swamped, knocked about or even overboard, and spilling fuel while trying to fill the tank.

One product known as the DuraMax® has been developed in an attempt to solve this problem. This particular device includes a fuel holding tank that typically holds about 14 gallons of fuel and includes a hose to deliver the fuel from the holding tank to the watercraft. There are two shut-off valves, at both the tank and hose connector, to disconnect the pump for refilling and transportation. This product, however, is not suitable for many potential users because it is relatively expensive and difficult to use because it is quite heavy for an individual to handle when full and is very slow and time consuming. Because the device is too large to fit into many passenger vehicles and so heavy when full, it generally requires a truck, trailer or some other gear to help transport the device back and forth from the fuel station.

Another product known as the Flo n' go Superflo® also attempts to solve the problem of trying to fill a tank from a hand-held fuel tank. This device is a fuel siphon that pumps gas with an at-the-handle pump control. It has a flow rate of approximately 1 gallon per minute in siphon mode. The Superflo® comprises a siphon/pump and a hose and optionally a fuel can. This product, however, is slow and time consuming when filling the tanks of personal watercraft and small boats.

U.S. Pat. No. 7,464,735 discloses a funnel stand that includes a housing supporting an internal funnel connected to a fuel hose that can be folded or rolled up for storage inside the housing and extended through a hose opening for placement in a fuel tank opening. In addition, the funnel stand may include a lid covering the funnel opening, a door covering the hose opening, and handles to facilitate carrying the device by hand. The funnel stand is designed to be suitable for delivering fuel from a hand-held fuel can into the fuel tanks on small watercraft, such as small boats and personal watercraft.

U.S. Pat. No. 7,048,020 discloses a connector on-board the vehicle, connected to the fuel tank via a pouring conduit and provided with a closure valve, and a filling element adapted to be connected to this connector. The filling element is provided with at least one member for detecting the abutment of the filling element on a fixed part of the connector, this member being adapted to control the displacement of a hook for locking the aforementioned element on the connector, between a first position where the hook is disengaged with respect to the connector and a second position where the hook is in engagement on the connector.

As a result, there is a need for an easier, more convenient and more cost effective way to load fuel onto watercraft while they are in the water. There is a further need for a better way to load fuel purchased at a land-based gas station onto watercraft while they are in the water, particularly while they are floating at a private dock. It would also be beneficial for the device to be universal for many different locations, unobtrusive, attractive, practical, light weight, and generally safe, easy and convenient to use.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a refuelling stand. In accordance with one embodiment of the present invention there is provided a refuelling stand for conveying fuel from a fuel source into a fuel receptacle comprising: a funnel having an upper bowl and a lower discharge end; a conduit having a first end for removable attachment to the lower discharge end of the funnel, and a second end for engagement with the fuel receptacle; and three or more support legs attached to the upper bowl of the funnel, wherein each of the support legs is independently movable from a first use mode to a second storage mode.

In accordance with another embodiment of the present invention there is provided a refuelling stand for conveying fuel from a fuel source into a fuel receptacle comprising: a funnel having an upper bowl and a lower discharge end; a conduit having a first end for removable attachment to the lower discharge end of the funnel, and a second end for engagement with the fuel receptacle; and a support assembly comprising two or more upright members and one or more horizontal support members.

BRIEF DESCRIPTION OF THE FIGURES

These and other features of the invention will become more apparent in the following detailed description in which reference is made to the appended drawings.

DETAILED DESCRIPTION OF THE INVENTION

Figure 1:
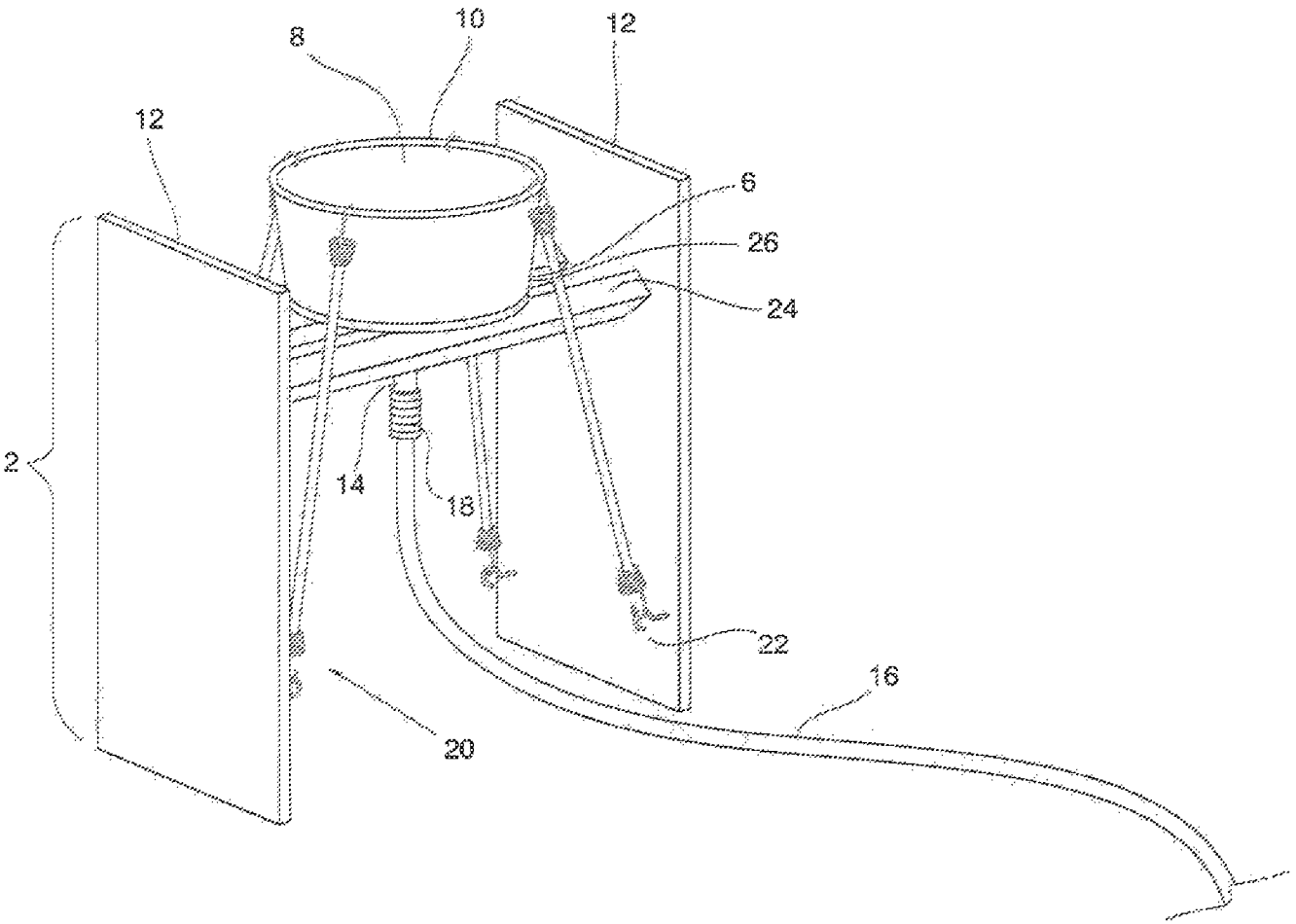
FIG. 1 presents a perspective view of the assembled refuelling stand ready for use in one embodiment of the present invention.

Unless defined otherwise, all technical and scientific terms used herein have the same meaning as commonly understood by one of ordinary skill in the art to which this invention belongs.

The present invention provides a refuelling stand that is lightweight and easily portable, and comprises a funnel; a support for the funnel, which is optionally collapsible, and a conduit which is removably attached to the end of the funnel. The stand is optionally provided with at least one stabilizer.

In one embodiment, there is provided a refuelling stand for conveying fuel from a fuel source into a fuel receptacle comprising: a funnel having an upper bowl and a lower discharge end; a conduit having a first end for attachment to the lower discharge end of the funnel, and a second end for engagement with the fuel receptacle; and three or more support legs attached to the upper bowl of the funnel.

In a preferred embodiment, each of the support legs is independently convertible from a first use mode to a second storage mode. In the use mode, the support legs are in a position suitable for stable support of the funnel. In the storage mode, the support legs and funnel form a smaller, more compact profile than the refuelling stand in use. In storage mode, the support legs may be telescoped or folded into a shorter length. In an alternative embodiment, the support legs are rotated inwardly into a position that takes up less space for storage. In a further embodiment, the support legs are both shortened and rotated inwardly. In yet another embodiment, the support legs are hinged inwardly into a position that takes up less space for storage. It is also contemplated that, in storage mode, the legs may be removed from the funnel.

The support legs are provided to support the funnel at a height suitable for fuel transfer. In one embodiment, the support legs are independently adjustable in length to accommodate the requirements of the user, for example, for use on an uneven surface.

In one such embodiment, the support legs are telescoping, and any suitable locking mechanism can be employed, including, but not limited to, twist (cam) locks, lever locks, spring button, snap collar, and set knobs.

Each of the support legs is attached to the upper bowl of the funnel via leg attachment means.

In one embodiment, leg attachment means include any means that allow for the reversible/removable attachment of the support legs to the funnel.

In one embodiment, the leg attachment means comprise openings in the upper bowl adapted to receive a support leg. In one embodiment, the legs are held in place in the opening by frictional engagement. In a further embodiment, the legs are received in the openings in the upper bowl and are optionally held in place through the use of split pins, cotter pins, button clips, snap buttons or the like. In a further embodiment, the support legs are received in the openings via screw fit engagement.

It is also within the scope of the present invention to provide attachment means that provide semi-permanent attachment, i.e., which require the use of tools to remove the support legs from the funnel. For example, the support legs may be held in place through the use of screws, or through the use of nut and bolt attachment.

In one embodiment, the leg attachment means comprise a hinged connection between each of the support legs and the upper bowl. In such an embodiment, the support legs are movable from the first use mode to the second storage mode via bending about the hinged connection.

In accordance with the present invention, the refuelling stand optionally comprises one or more stabilizers to stabilize the support legs in the first use mode.

In one embodiment, the stabilizers comprise one or more reinforcement brackets extending from one or more of the support legs to the lower discharge end of the funnel. In one embodiment, the reinforcement brackets connect to a ring which is sized to surround the discharge end of the funnel. In one embodiment, the reinforcement bracket is a rigid connection between the ring and the respective leg(s), and the ring is sized to move along the discharge end of the funnel to facilitate conversion of the stand from use mode to storage mode. In a further embodiment, the reinforcement bracket is a flexible link extending between each leg and the funnel.

In a further embodiment, the stabilizers comprise a flexible link between adjacent support legs. In such an embodiment, the flexible links are configured to allow the inward movement of the legs into storage mode, while also stabilizing the legs in use mode.

In a further embodiment, there is provided a refuelling stand for conveying fuel from a fuel source into a fuel receptacle comprising: a funnel having an upper bowl and a lower discharge end; a conduit having a first end for attachment to the lower discharge end of the funnel, and a second end for engagement with the fuel receptacle; and a support assembly comprising two or more upright members and one or more horizontal support members.

The refuelling stand of this embodiment optionally comprises one or more stabilizers extending between the upright support members and the funnel. In one embodiment, the stabilizers are elasticated (bungy-type) connectors. In one embodiment, the stabilizers comprise one or more reinforcement brackets extending from the upright support members to the lower discharge end of the funnel.

In such an embodiment, the upright support members may be provided in a generally vertical or off-vertical (e.g., at an angle of between about 5 to about 20 degrees from perpendicular) orientation.

In accordance with this embodiment, the one or more horizontal support members are configured to extend between the two or more upright support members, and can be of any shape suitable for stable support of the funnel when the stand is in use mode. In one embodiment, the horizontal support member is a generally planar body with an opening of suitable shape and size for accommodate at least the discharge end of the funnel. In another embodiment, the funnel is supported by two horizontal support members spaced apart from each other to provide a gap between the respective support members of suitable shape and size to accommodate at least the discharge end of the funnel.

In an alternative configuration, the one or more horizontal support members rest on the two or more upright members in a table-like configuration.

In one embodiment, the support assembly comprises a horizontal support member supported by three upright support members, wherein the upright support members are each a support leg. In such an embodiment, the stand is constructed in a stool-like configuration, where the horizontal support member is similar to the seat of the stool. In one version of this embodiment, the neck of the funnel passes through a hole located in the plane of the "seat" of the stool.

To facilitate transfer of the fuel from the funnel to the fuel receptacle, a conduit is attached to the lower discharge end of the funnel. The conduit is a flexible tube, manufactured from any material suitable for use in transferring petroleum based fuels, Suitable materials include, but are not limited to, polyvinyl chloride (PVC), braided PVC, natural and synthetic rubbers (e.g., nitrile rubber (Buna-N)), vinyl, nylon, Tygon®, Viton®, Neoprene, PVDF (polyvinylidene fluoride), acetal, polypropylene, PTFE (polytetrafluoroethylene), and PEEK (polyether ether ketone).

In one embodiment, the first end of the conduit is attached to the lower discharge end of the funnel end via frictional engagement, wherein the conduit is sized for snug fit around the discharge end. In such an embodiment, it is also preferred that the conduit be manufactured from a material that is suitable for stretching fit around the end of discharge end to ensure secure attachment.

It is also contemplated that the conduit be attached to the lower discharge end via a conduit attachment means.

In one embodiment, the conduit attachment means comprises a hose clamp. Such a configuration is also suitable for use in combination with the frictionally engaged conduit, to ensure the attachment is secure.

In a further embodiment, the conduit attachment means comprises a male threaded portion on the lower discharge end of the funnel, a flange on the first end of the conduit, and a threaded cap adapted to receive the male threaded portion thereby providing sealing engagement of the flange with the lower discharge end.

It is also contemplated that the conduit attachment means comprises a male threaded portion located on the conduit, adapted to engage a threaded opening on the funnel.

In one embodiment, the upper bowl of the funnel further comprises a splash guard.

In one embodiment, the upper bowl of the funnel is collapsible.

In one embodiment, the upper bowl of the funnel further comprises an indentation adapted to receive a nozzle on the fuel source.

The invention will now be described with reference to specific examples. It will be understood that the following examples are intended to describe embodiments of the invention and are not intended to limit the invention in any way.

In one embodiment, the refuelling stand comprises a support configured to hold the funnel in a secure and convenient position suitable for receiving fuel from a hand held can, or similar source of fuel. In this embodiment, the funnel rests on a horizontal support, which is held in place by at least two vertical supports. It is within the scope of the present invention that the horizontal support can have any configuration suitable for holding the funnel in place.

The refuelling stand is of minimal construction intended for easy assembly and disassembly. A worker skilled in the art could readily determine the appropriate materials to construct the support of the invention. For example, the support may be constructed out of plastic, wood, composite material, metals or combinations thereof. In one embodiment, the refuelling stand comprises a support of rigid lightweight material consisting of two vertical supports and two horizontal supports which link the two vertical supports to each other. The support may be configured such that the mouth of the funnel may be located above or below the top surface of the vertical supports.

In one embodiment of the present invention, there is provided a refuelling stand as shown in FIG. 1. In this embodiment, the refuelling stand comprises a support (2) of rigid lightweight material consisting of two parallel vertical supports (4) and two parallel horizontal supports (6) which link the two parallel vertical supports to each other. The parallel horizontal supports (6) are configured to support a funnel (8) between the parallel vertical supports (4). In this embodiment of the invention the neck of the funnel (14) is located below the parallel horizontal supports (6) and the conduit (16) is attached therein. In the embodiment of the invention depicted in FIG. 1, there are four stabilizers, each one extending from a respective corner of the inner surface (22) of the two parallel vertical supports (4) to the mouth of the funnel (10). Each stabilizer (20) is attached to the mouth of the funnel (10) by passing along the outer surface (24) of the two parallel horizontal supports.

Figure 2:
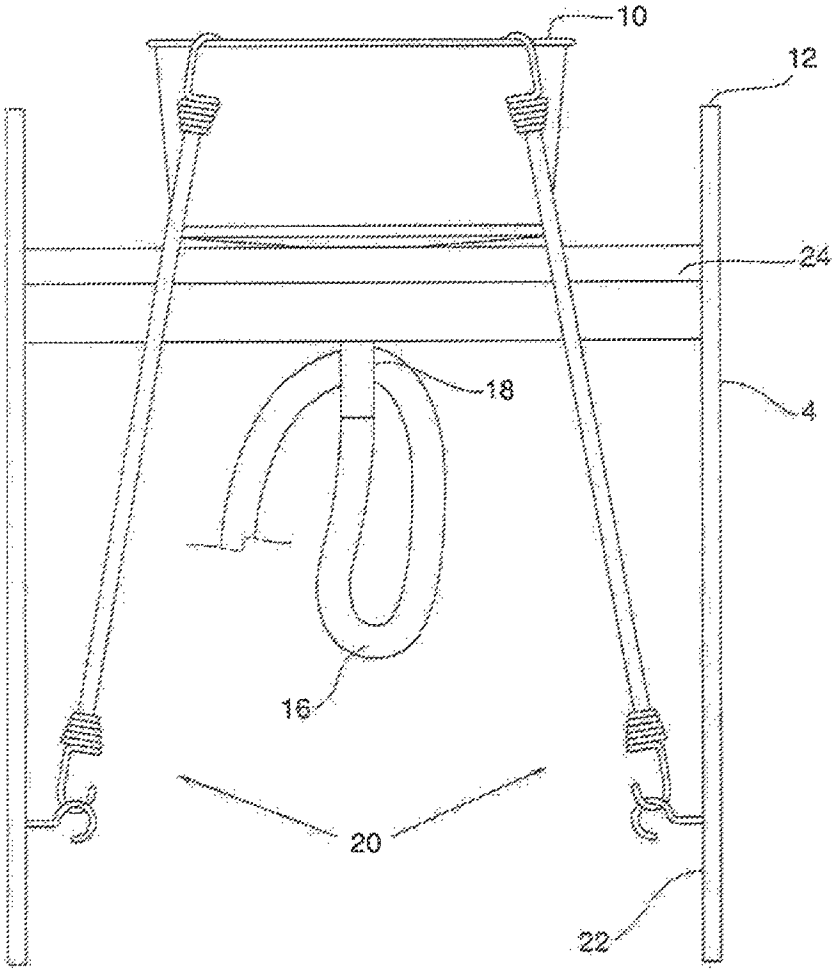
FIG. 2 presents a perspective view of the assembled refuelling stand stored in between uses in one embodiment of the present invention.

In one embodiment, the conduit is made of a material allowing for folding and storage within the two vertical supports. Such an embodiment is illustrated in FIG. 2. By way of example, the conduit could be a hose, plastic tube, rubber, silicone or other suitable means, either flexible or substantially rigid, for transporting fuel from the funnel to the desired receptacle. In one embodiment, the conduit would be of transparent material to ease the end user in judging when a receptacle could receive no additional fuel. The lightweight portable nature of the refuelling stand allows for the easily refuelling of difficult to reach fuel tanks such as water pleasure crafts, personal aircraft, farm equipment and recreational vehicles such as ATVs, snowmobiles and dirt bikes which cannot travel on sanctioned roadways. The conduit may be frictionally attached to the neck of the funnel or be fixedly attached to the neck of the funnel by coupling means. Examples of such coupling means include, but are not limited to, couplers as are known in the art such as clips, cinches or bands.

The invention may further comprise at least one stabilizer which stabilizes the funnel on the support. In one embodiment of the invention, each stabilizer extends from one of the two vertical supports to the mouth of the funnel. In one embodiment of the invention, there are four stabilizers, each one extending from a respective corner of the inner surface of the two parallel vertical supports to the mouth of the funnel. The at least one stabilizer can attach to the mouth of the funnel by passing along the outer surface of the two horizontal supports or may optionally pass between the two horizontal supports along the inner surface. The attachment stabilizers could be hook and link combinations, telescoping attachments, chains, weights or any other stabilizing means known to those of skill in the art.

Figure 3:
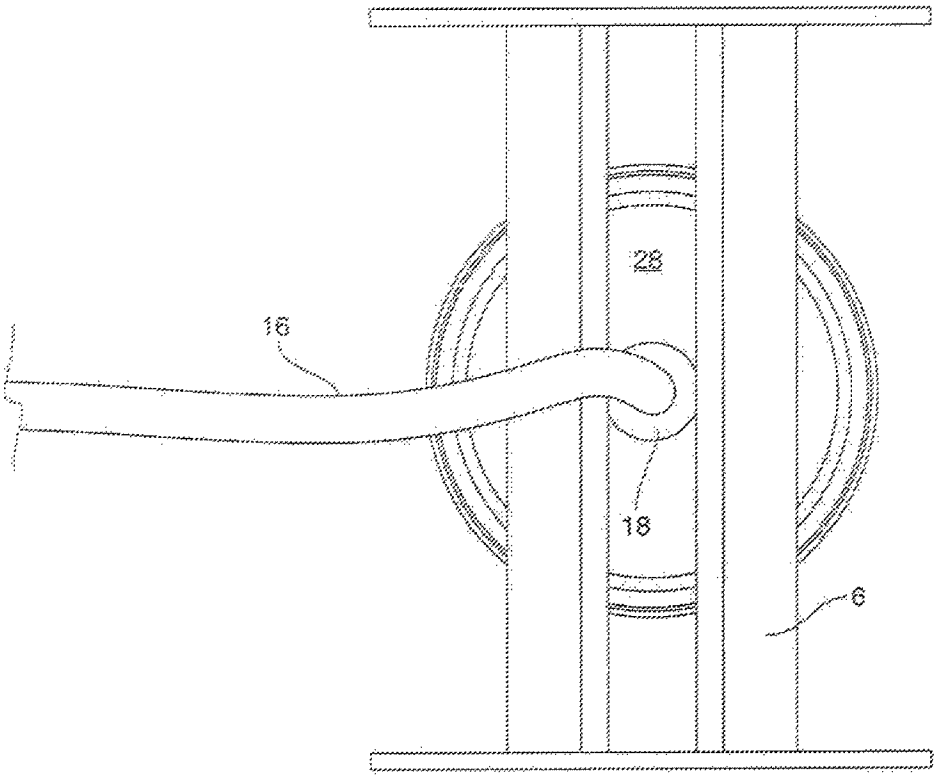
FIG. 3 presents a bottom view of the refuelling stand of the embodiment set forth in FIG. 1.

In another embodiment of the invention the refuelling stand does not require at least one stabilizer. As illustrated in FIG. 3, the distance between the two horizontal supports 6 is wide enough to fully support the base of the funnel 28 without the requirement for stabilizers. In another embodiment of the invention, the two horizontal supports may be angled in a slightly downward fashion to frictionally engage the base of the funnel 28 such that the angled horizontal supports 6 provide a stable retaining of the funnel base 28 thereby preventing the funnel 8 from falling out or coming askew from the support 2. The support retains the funnel 8 within the refuelling stand but the funnel remains easily removable from the support 2 by pulling it up and out from between the two parallel supports 4 or, optionally, removing any stabilizers 20 and removing the funnel.

Figure 5B:
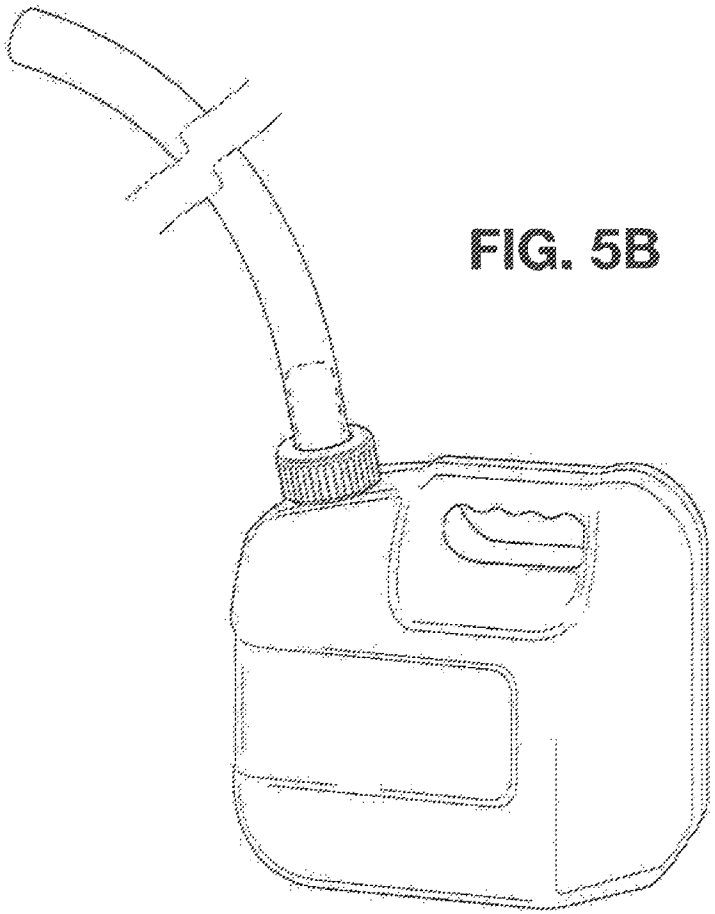
FIG. 5B presents an assembled view of the conduit adapter.
Figure 5A:
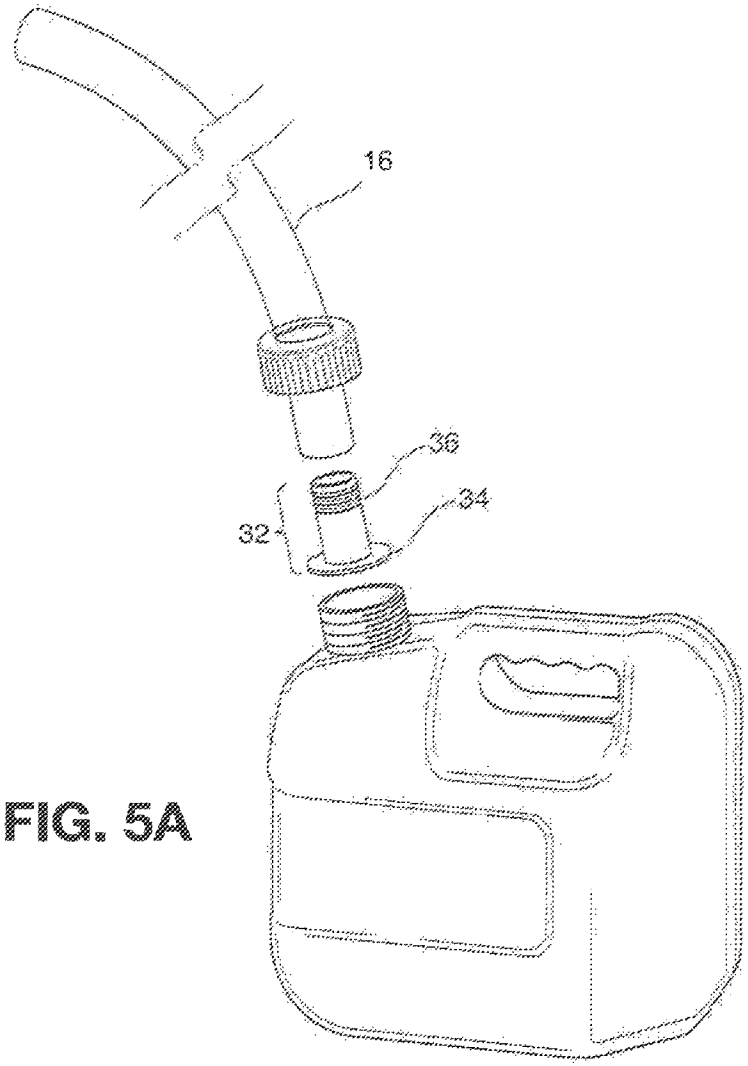
FIG. 5A presents an exploded view of the conduit adapter.

In another embodiment of the invention, as illustrated in FIGS. 5A and 5B, there is provided an adapter 32 for connecting a conduit to an opening of a hand-held fuel can, the adapter having two ends, wherein one end 34 is a flange for sealing engagement with the opening of the fuel can and the second end is an extending member 36 which frictionally engages internally with the conduit 16. In this embodiment of the invention the conduit 16 is attached directly to the hand-held fuel can and the fuel is poured directly into the gas tank. In another embodiment the hand-held fuel can may rest on the support 2. Suitable materials for constructing the adapter would be known to a worker skilled in the art.

Figure 6:
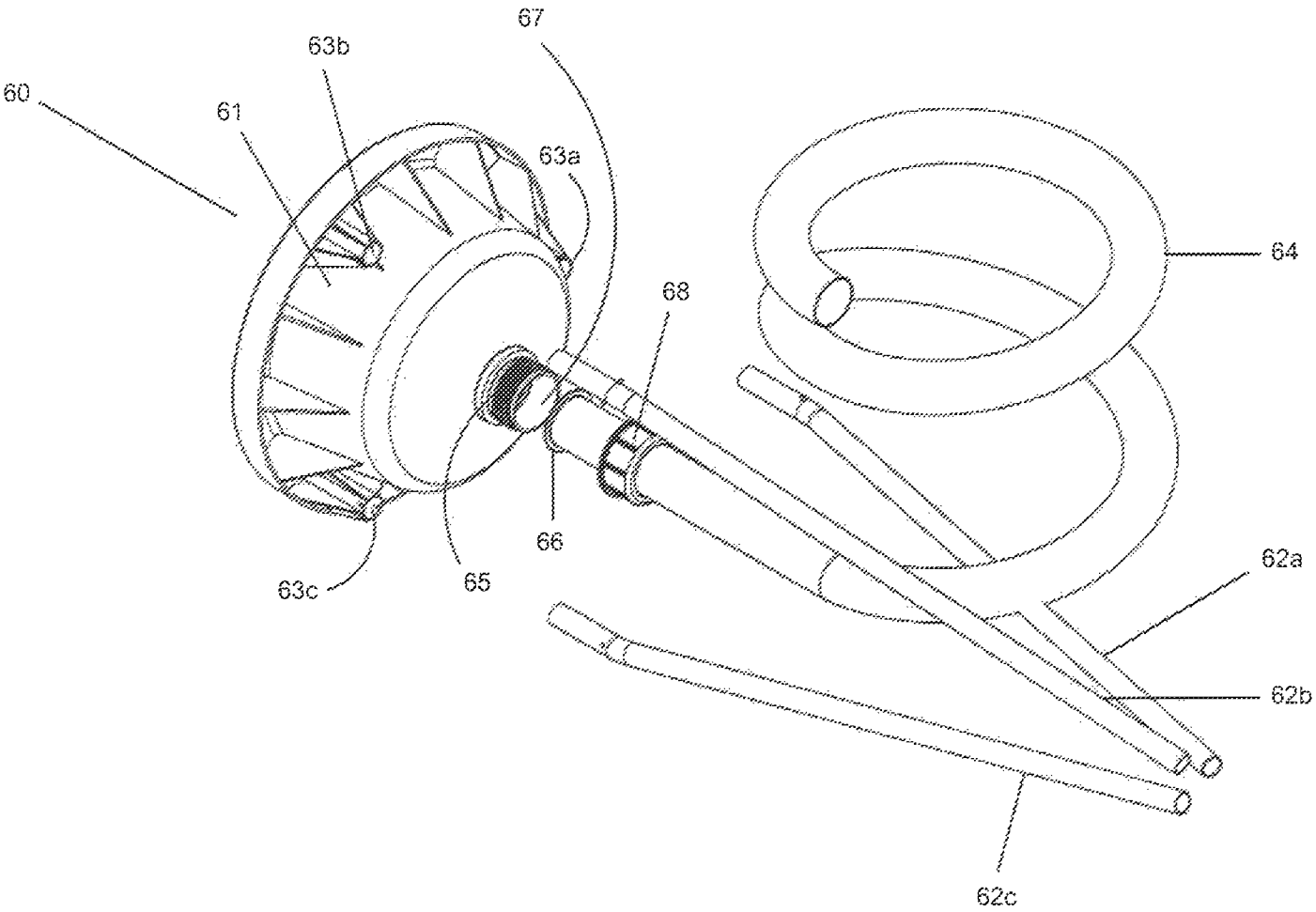
FIG. 6 presents a bottom perspective view of a disassembled refueling stand in one embodiment of the present invention.
Figure 8:
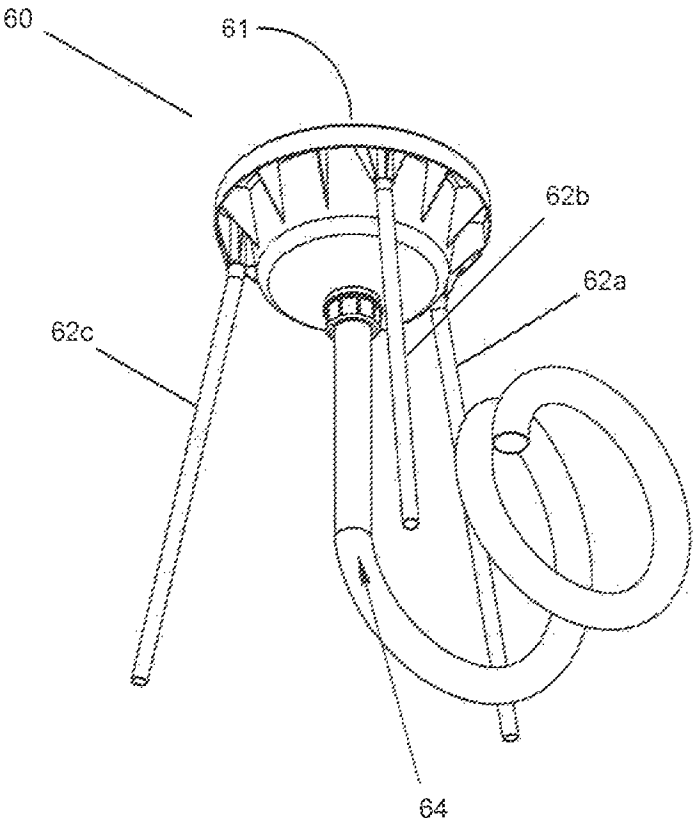
FIG. 8 presents a bottom perspective view of an assembled refueling stand of the embodiment set forth in FIG. 6 in use mode.
Figure 7:
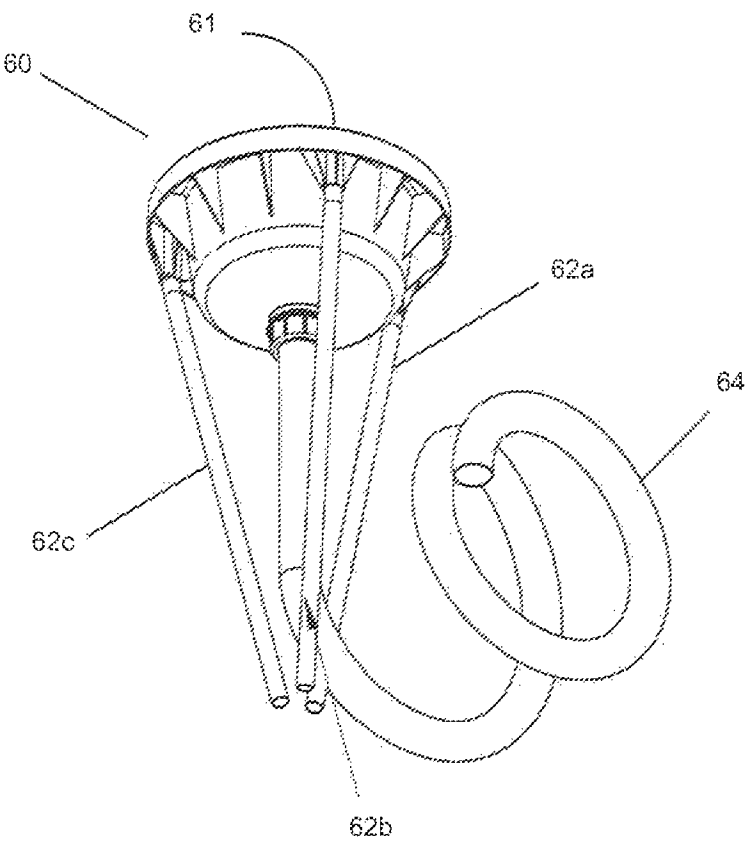
FIG. 7 presents a bottom perspective view of an assembled refueling stand of the embodiment set forth in FIG. 6 in storage mode.

In a further embodiment depicted in FIGS. 6 to 8, legs 62A, 62B and 62C are each fitted into respective openings 63A, 63B and 63C in funnel 61. In this embodiment, legs 62A, 62B and 62C are configured to be rotatable from the use mode (depicted in FIG. 8) to the storage mode (depicted in FIG. 7).

As is depicted in FIG. 6, the conduit attachment means comprises male threaded portion 65 on lower discharge end 67 of funnel 61, flange 66 on the first end of conduit 64, and threaded cap 68 adapted to receive the male threaded portion 65.

The embodiment of FIG. 6 is depicted as employing frictional engagement of the legs in the openings, but it is contemplated that the legs may be held in place using any suitable means, including but not limited to screw fit, or the use of attachment means such as button clips, screws, etc. as discussed above.

Figure 9:
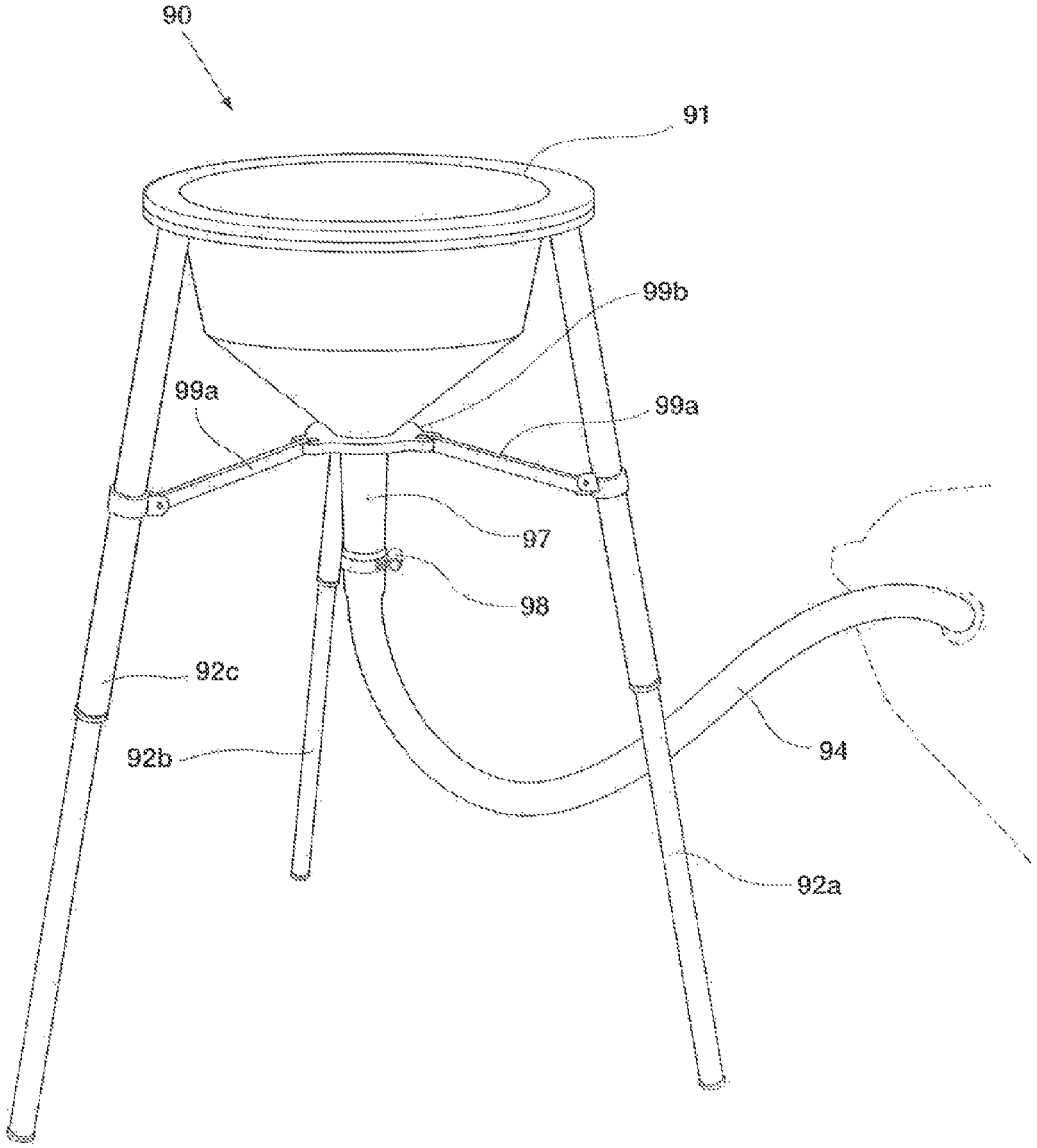
FIG. 9 presents a perspective view of a refueling stand in one embodiment of the present invention.
Figure 10:
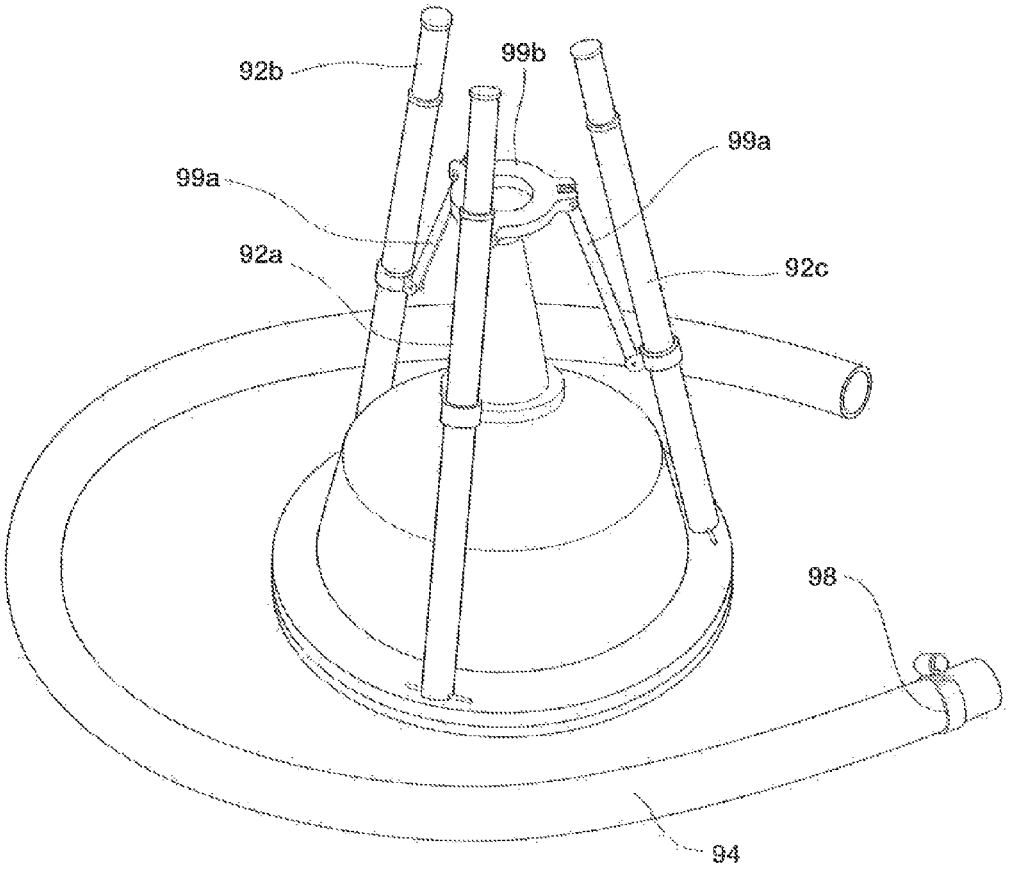
FIG. 10 presents a perspective view of a refueling stand of the embodiment set forth in FIG. 9 in storage mode.

In a further embodiment depicted in FIGS. 9 and 10, legs 92A, 92B and 92C are adjustable in length, employing a twist lock mechanism suitable for independently adjusting the leg length. In the embodiment of FIGS. 9 and 10, the leg position is stabilized by reinforcement brackets 99A connected to ring 99B, which is sized to surround discharge end 97 of funnel 91. Each reinforcement bracket 99A is rigid and forms a connection between ring 99B and legs 92A, 92B and 92C, and the ring is sized to move along the discharge end of the funnel to facilitate conversion of the stand from use mode to storage mode. In this embodiment, hose 94 is attached to the discharge end via hoseclamp 98.

Figure 11:
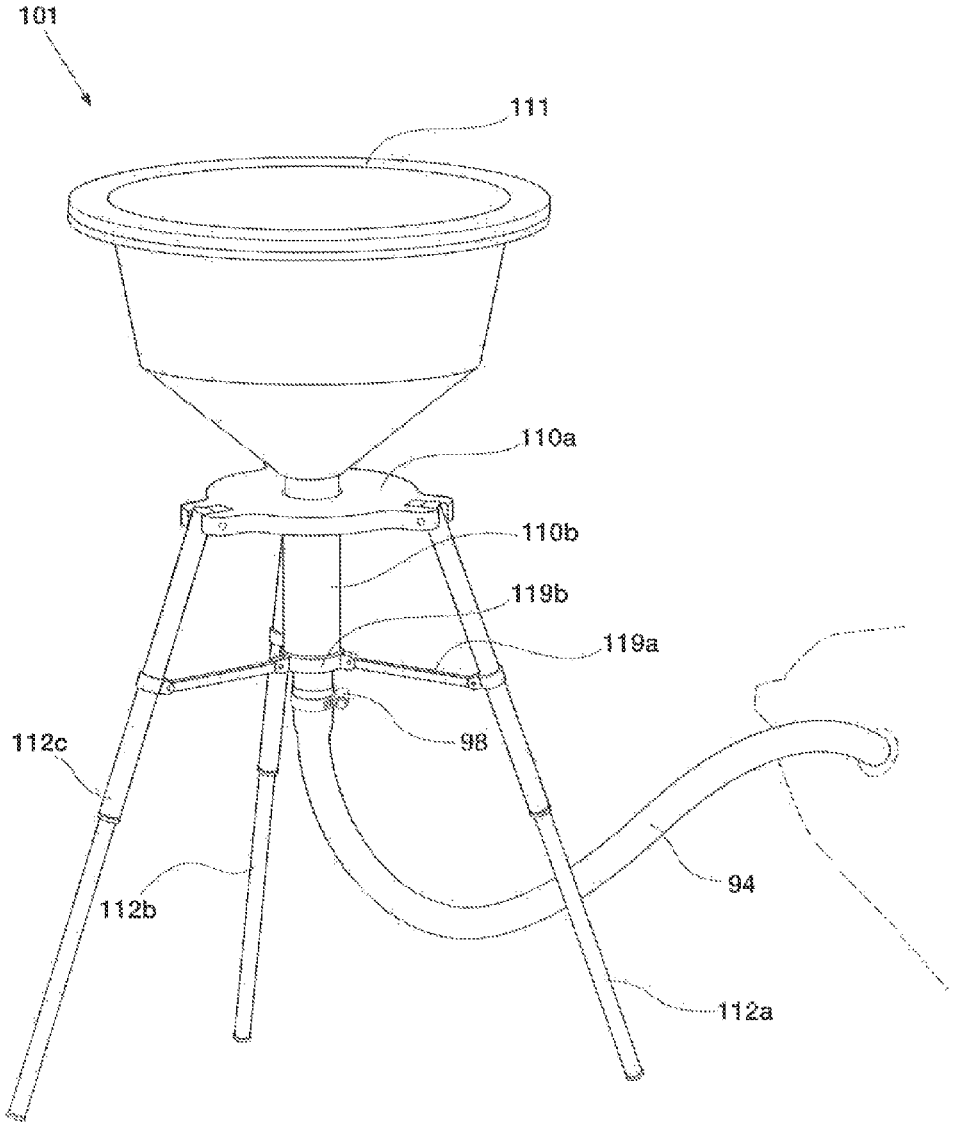
FIG. 11 presents a perspective view of a refueling stand in one embodiment of the present invention.

In the further embodiment depicted in FIG. 11, refuelling stand 101 comprises funnel 111, which rests on planar horizontal support 110*a* having a hole therein sized to accommodate the discharge end of the funnel. Horizontal support 110*a* further comprises tubular extension 110*b* through which the discharge end extends, the horizontal support being supported by three upright supports 112*a*, 112*b* and 112*c*. In this embodiment, hose 104 is attached to the discharge end via hoseclamp 108, and the leg position is stabilized by reinforcement brackets 119*a* connected to ring 119*b* which is sized to surround the discharge end of funnel 111.

Figure 4:
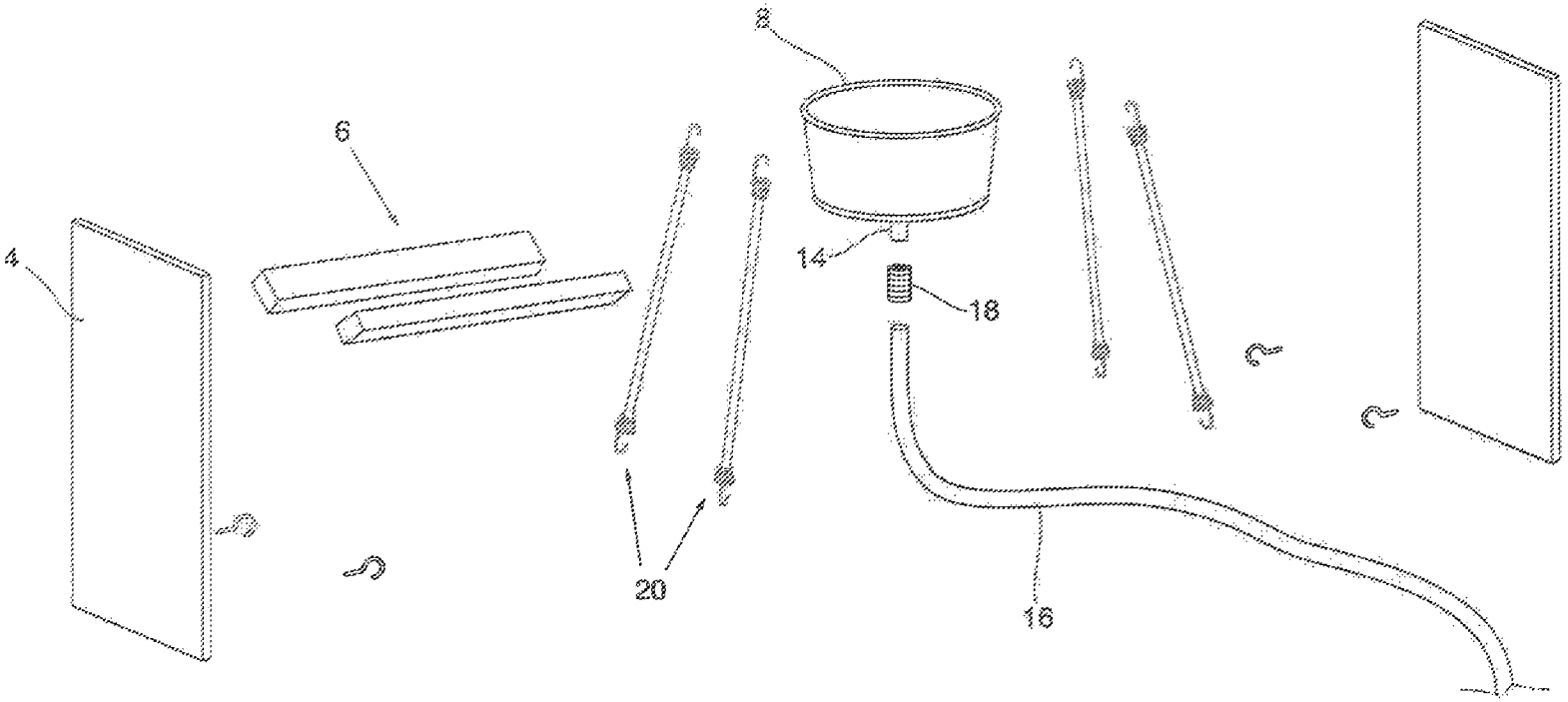
FIG. 4 presents a disassembled view of the refuelling stand prepared for packaging as a kit in one embodiment of the package containing a product.

In another embodiment of the invention the refuelling stand is provided as a kit. As illustrated in FIGS. 4 and 6, all the presently disclosed elements of the refuelling stand can be readily disassembled and provided as a kit. The funnel in the kit may be collapsible. The kit can further comprise instructions for assembly and optionally, instructions for cleaning and storing the refuelling stand.

In a further embodiment of the invention, the kit packaging can be reused for the storage of the refuelling stand. Preferably, the kit would retain the elements of the refuelling apparatus and maintain them in a secure position for storage for transportation on water pleasure crafts, personal aircraft, farm equipment and recreational vehicles such as ATVs, snowmobiles and dirt bikes.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

I claim:

1. A refuelling stand for conveying fuel from a fuel source into a fuel receptacle comprising:

a funnel having an upper bowl and a lower discharge end;

a conduit having a first end for removable attachment to the lower discharge end of the funnel, and a second end for engagement with the fuel receptacle; and three or more support legs attached to the upper bowl of the funnel, wherein each of the support legs is independently movable from a first use mode to a second storage mode.

2. The refuelling stand of claim 1, wherein the conduit is a flexible tube.

3. The refuelling stand of claim 2, wherein the first end of the conduit is attached to the lower discharge end of the funnel end via frictional engagement.

4. The refuelling stand of claim 2, wherein the conduit is attached to the lower discharge end via a conduit attachment means.

5. The refuelling stand of claim 4, wherein the conduit attachment means comprises a male threaded portion on the lower discharge end of the funnel, a flange on the first end of the conduit, and a threaded cap adapted to receive the male threaded portion thereby providing sealing engagement of the flange with the lower discharge end.

6. The refuelling stand of claim 4, wherein the conduit attachment means comprises a hoseclamp.

7. The refuelling stand of claim 1, wherein each of the support legs is attached to the upper bowl via leg attachment means.

8. The refuelling stand of claim 7, wherein the leg attachment means comprise openings in the upper bowl adapted to receive one of the three or more support legs.

9. The refuelling stand of claim 8, wherein the support legs are received in the openings via screw fit engagement.

10. The refuelling stand of claim 1, wherein the support legs are movable from the first use mode to the second storage mode via rotation.

11. The refuelling stand of claim 7, wherein the leg attachment means comprise a hinged connection between each of the support legs and the upper bowl.

12. The refuelling stand of claim 11, wherein the support legs are movable from the first use mode to the second storage mode via bending about the hinged connection.

13. The refuelling stand of claim 1, wherein the support legs are collapsible.

14. The refuelling stand of claim 1, further comprising one or more stabilizers to stabilize the support legs in the first use mode.

15. The refuelling stand of claim 14, wherein the stabilizers comprise one or more reinforcement brackets extending from one or more of the support legs to the lower discharge end of the funnel.

16. The refuelling stand of claim 14, wherein the stabilizers comprise a flexible link between adjacent support legs.

17. A refuelling stand for conveying fuel from a fuel source into a fuel receptacle comprising:

a funnel having an upper bowl and a lower discharge end;

a conduit having a first end for removable attachment to the lower discharge end of the funnel, and a second end for engagement with the fuel receptacle, wherein the conduit is a flexible tube; and a support assembly comprising two or more upright members and one or more horizontal support members;

wherein the support assembly comprises one horizontal support member supported by three upright members, wherein the upright members are each a telescoping leg.

18. A refuelling stand for conveying fuel from a fuel source into a fuel receptacle comprising:

a funnel having an upper bowl and a lower discharge end;

a conduit having a first end for removable attachment to the lower discharge end of the funnel, and a second end for engagement with the fuel receptacle, wherein the conduit is a flexible tube; and a support assembly comprising two or more upright members and one or more horizontal support members;

further comprising one or more stabilizers extending between each of the upright support members and the funnel.

* * * * *